US006853734B2

(12) United States Patent
Sahyoun

(10) Patent No.: US 6,853,734 B2
(45) Date of Patent: Feb. 8, 2005

(54) AUDIO SPEAKER DAMPER WITH ELECTRICALLY CONDUCTIVE PATHS THEREON TO CARRY VOICE COIL SIGNALS AND A METHOD THEREFORE

(76) Inventor: Joseph Y. Sahyoun, 3031 Hopkins Ave., Redwood City, CA (US) 94062

( * ) Notice: Subject to any disclaimer, the term of this patent is extended or adjusted under 35 U.S.C. 154(b) by 24 days.

(21) Appl. No.: 10/440,783

(22) Filed: May 19, 2003

(65) Prior Publication Data

US 2004/0001603 A1 Jan. 1, 2004

Related U.S. Application Data

(60) Provisional application No. 60/382,298, filed on May 20, 2002.

(51) Int. Cl.[7] ..... H04R 25/00

(52) U.S. Cl. ..... 381/404; 381/403; 381/405; 381/410

(58) Field of Search ..... 381/396, 400, 381/403, 404, 405, 409, 410; 181/171; 29/594, 609.1, 857

(56) References Cited

U.S. PATENT DOCUMENTS 1,957,562 A * 5/1934 Tolerton ..... 381/404
6,144,753 A * 11/2000 Ohyaba et al. ..... 381/405
6,700,988 B2 * 3/2004 Wu ..... 381/404

* cited by examiner

*Primary Examiner*—Huyen D. Le
(74) *Attorney, Agent, or Firm*—Allston L. Jones

(57) ABSTRACT

A linearly compliant, flexible, resilient and flat speaker damper connected between the frame and the cone of the speaker with electrically conductive paths applied to the damper to conduct the signal to be applied to the voice coil of the speaker. A method for linearly compliant audio speaker damping and a method for application of voice coil conductors on the damper.

18 Claims, 5 Drawing Sheets

AUDIO SPEAKER DAMPER WITH ELECTRICALLY CONDUCTIVE PATHS THEREON TO CARRY VOICE COIL SIGNALS AND A METHOD THEREFORE

CROSS-REFERENCE

The present application claims priority from a previously filed Provisional Patent Application by the same title having Ser. No. 60/382,298 that was filed on May 20, 2002.

BACKGROUND OF THE INVENTION

1. Field of the Invention

The present invention is related generally to audio speakers, and more specifically to an audio speaker damper connected between the frame and the cone of the speaker with an electrically conductive path on the damper for the voice coil audio signal, and a method therefore.

2. Description of Related Art

Prior art speaker dampers, also known as spiders, in most prior art speakers are made from cloth that has been stiffened. When new, prior art spiders provide a substantially proportional, linear resistance to the movement of the speaker cone on the in-stroke versus the out-stoke. However, after 4 to 5 months of use the cloth damper, or spider, stretches and becomes concave or convex. When the spider stretches, proportionality and linearity are both lost since the spider becomes heavily biased in one direction, either to the in-stroke or to the out-stroke of the speaker cone. That loss of proportionality and linearity results in the spider presenting a different resistance on the out-stroke versus the in-stroke, which reveals itself to the listener in the form of massive distortion of the audio sound.

An additional problem presented in prior art speakers is placement, length and strength of the electrical conductors connecting the voice coil to electrical terminals on the speaker frame from which the speaker is connected to an audio system amplifier. There are two common techniques used in the prior art to make the connection between the voice coil and the speaker terminals typically located on the speaker frame. One is to run a portion of the free ends of the soft conductors of the voice coil along a portion of the speaker cone with those portions of the conductors glued to the cone, and the end of each conductor drawn through a hole in the cone and then across the space from the cone to the speaker terminals. This configuration requires the wires to have an elastic behavior during deep inward and outward strokes of the voice coil and cone that forces the portion of the wires in open space to wobble and make noise.

Nowadays with speaker designers trying to minimize speaker profiles, the use of a spider is more problematic since the use of tensile voice coil leads require more speaker mounting depth. For speakers used in limited depth locations, such as notebook computers, toys, cell phones, PDAs (personal data assistants), etc.

In woofer design, the prior art use of tensile leads causes massive audible distortion from the speaker due to the tensile leads flapping up and down on the cone as it moves during long inward and outward strokes. Shortening the tensile leads was thought to be a reasonable technique to reduce that noise. However, that proved to be more problematic on the assembly line as the worker tended to make the tensile lead wire too short. Those shorter leads broke either because then were too short for the maximum travel of the speaker cone when in use, or by the wire leads being overly flexed during speaker use since the shorter leads were flexed and stretched much more than the previously used longer leads. In either situation the leads eventually broke during operation of the speaker with the speaker ceasing to function with all output from the speaker lost, not only distorted as with the longer tensile leads.

In short, the prior art speakers experience numerous problems:

1. they can not be used where the mounting depth is shallow;
2. precise assembly is required to minimize distortion and maximize speaker life;
3. assembly is complex and time consuming;
4. number of speaker cone cycles over the life of the speaker is marginal;
5. distortion results from tensile lead noise;
6. spider design results in distortion due to an uneven force strain for inward vs. outward movement within a short period of the first use of the speaker; and
7. speaker cost of production, and to the consumer, is impacted by the use of separate components for the damper, tensile wires, clamps and the installation of same.

The present invention overcomes or minimizes these problems presented by prior art speakers.

SUMMARY OF THE INVENTION

A linearly compliant, flexible, resilient and flat speaker damper connected between the frame and the cone of the speaker with electrically conductive paths applied to the damper to conduct the signal to be applied to the voice coil of the speaker. A method for linearly compliant audio speaker damping and a method for application of voice coil conductors on the damper.

DESCRIPTION OF THE PRESENT INVENTION

Figure 1:
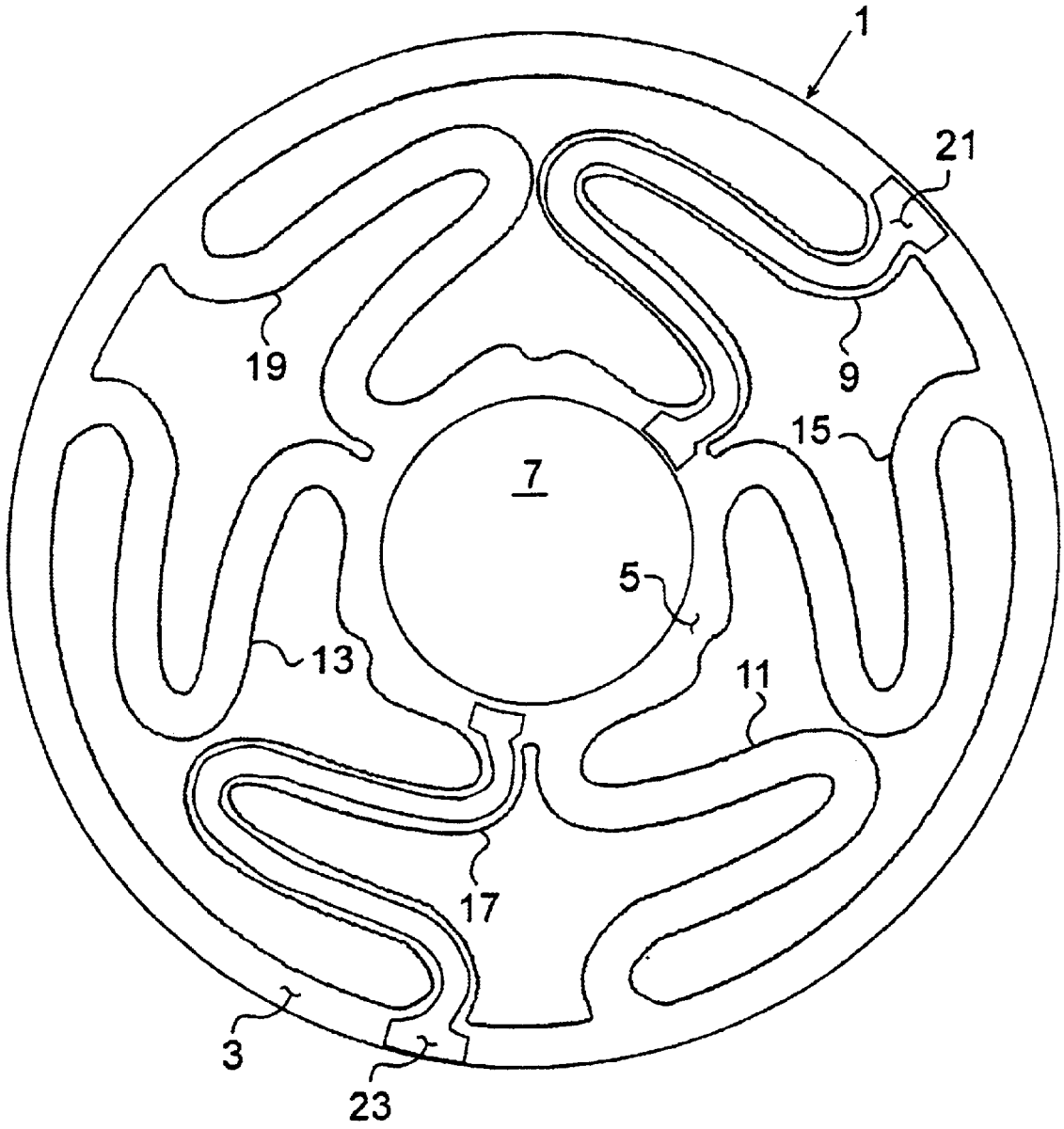
FIG. 1 is a plan view of a representative spider of the present invention with connected serpentine segments having electrical conductors on two of the segments.

FIG. 1 is a plan view of a representative spider 1, or damper 1, of the present invention that has symmetrical and proportional resistance to force (inward versus outward) while having a wobble resistance structure. In addition, spider 1 offers a more resilient lateral resistance along with soft and linear compliance along the excursion of the voice coil of the speaker. Spider 1 has an outer ring 3 and an inner ring 5. In use, the spider of FIG. 1 is mounted with inner ring 5 attached to the cone in close proximate to the point where the voice coil connects to the cone, and outer ring 3 is affixed to a selected point within the speaker frame, or basket, opposite and in substantially the same plane as the juncture of the voice coil and the center of the cone. This is possible since inner ring 5 that defines a central hole 7 has a diameter that is slightly greater than the diameter of the cone at the point of connection.

In FIG. 1, outer ring 3 and inner ring 5 are connected to each other through a plurality of serpentine segments 9–19 that function as flat springs. When the speaker that is equipt with spider 1 is in use, outer ring 3 is in a fixed position on the interior of the speaker basket and inner ring 5 moves together with the voice coil. Serpentine segments 9–19 provide the flexibility of spider 1. In FIG. 1, there are shown an even number of serpentine segments, namely six with a serpentine pattern of alternating segments having a mirror image shape. That is, segments 9, 11 and 13 have the farthest extend of the primary bend pointing counter-clockwise, and segments 15, 17 and 19 have the farthest extend of the primary bend pointing clockwise. With this balanced orientation of the segments, inner ring 5 will not turn as the voice coil moves during operation of the speaker.

Additionally, spider 1 of FIG. 1 is shown having two electrically conductive traces 21 and 23 that have been formed on segments 9 and 17, respectively. Traces 9 and 17 at inner ring 5 are provided for electrical attachment of different ones of the two ends of the voice coil wire, and at outer ring 3 are provided for connection to the speaker input terminals on the speaker frame. Since ring 3 remains in a fixed position during operation of the speaker, the technique for connection between the speaker input terminals and traces 21 and 23 can be accomplished by extending a wire between the terminals and traces, or by mechanical and electrical interconnection of the terminal and ring 3. Since ring 3 is not moving, the interconnection wires between traces 21 and 23 and the input terminals are not flexed and therefore can not provide distortion during speaker operation.

With inner ring 5 connected to the cone in close proximity to the junction with the voice coil, the distance between the two ends of the voice coil and the ends of traces 21 and 23 on spider 1 is minimized thus permitting connection of the two ends of the voice coil wire to traces 21 and 23 with little or no portion of the voice coil wire along the face of the cone. Thus, there can be little or no distortion added by the portion of the voice coil wire dressed along the face of the cone.

Between inner ring 5 and outer ring 3 the flexing of traces 21 and 23 is the same as that of each segment of spider 1 since traces 21 and 23 are connected along their entire length with the corresponding segment of the spider. Thus, the connection between the voice coil and the speaker terminals will not result in flapping or breaking of tensile leads.

While traces 21 and 23 are shown on opposite sides of spider 1, they could be placed on any two segments that are convenient based on the wire pattern of the voice coil and secondarily the location of the input terminals of the speaker. Additionally, if necessary, two side-by-side traces could be used on the same segment of spider 1. Another option is the placement of the two traces on opposite sides, namely top and bottom, of the same segment of the spider.

The material from which spider 1 is made can be any that will provide flexure in use without failure or deformation in use in the range of motion required. The material is most likely to be a non-heat or electrical conductive material, however any material, conductive or non-conductive, could be used.

There are numerous methods for attaching traces 21 and 23 to spider 1 which is discussed below since the same techniques could be used with any spider design. It should be noted that if the voice coil has multiple windings, two conductive traces can be included on additional spider segments similar to traces 21 and 23 shown in FIG. 1.

Figure 2:
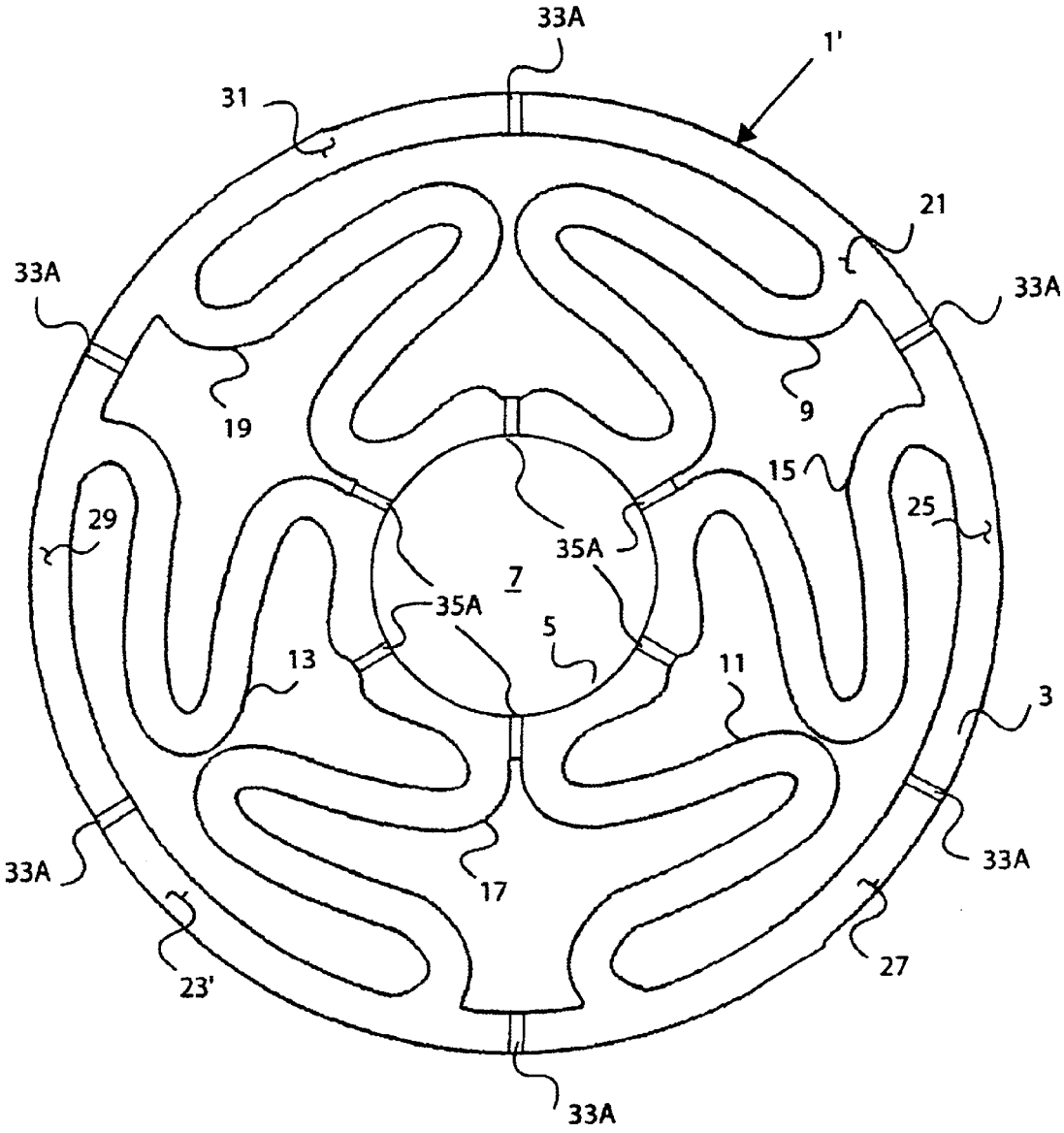
FIG. 2 is the spider of FIG. 1 with each of the segments having separate electrical conductors.

FIG. 2 presents an alternative to spider 1 of FIG. 1. Spider 1' of FIG. 2 has the same basic structure with outer ring 3, inner ring 5 and alternating serpentine segments 9–19. The difference is in the pattern of the conductive traces on spider 1'. In the embodiment illustrated in FIG. 2, there are six conductive traces 21', 23', 25, 27, 29 and 31 each located on a different segment and extending around a portion of inner ring 5 and outer ring 3. Each of traces 21', 23', 25, 27, 29 and 31 are electrically isolated from each other outer ring 3 and inner ring 5 with non-electrically conductive spaces 33A and 35A, respectively, between them.

With a conductive trace on each segment and along a substantial portion of outer and inner rings 3 and 5, the assembly of the speaker is simplified since, in any position, there will be a conductive trace near both ends of the voice coil wire. Particularly, with each trace having a substantial portion along the outer and inner rings 3 and 5 an elongated connection point is provided to receive either the wires from the input terminals of the speaker or the voice coil, respectively.

Alternatively, this embodiment allows the use of more than one trace for each of end of the voice coil wire if desired. Further, as many as five voice coils could be activated with one trace common to all voice coils, or three isolated voice coils could be powered by three different pairs of the traces on spider 1'. With the addition of similar conductive traces on the underside of the spider, twice as many voice coils can be accommodated in the speaker.

Figure 4:
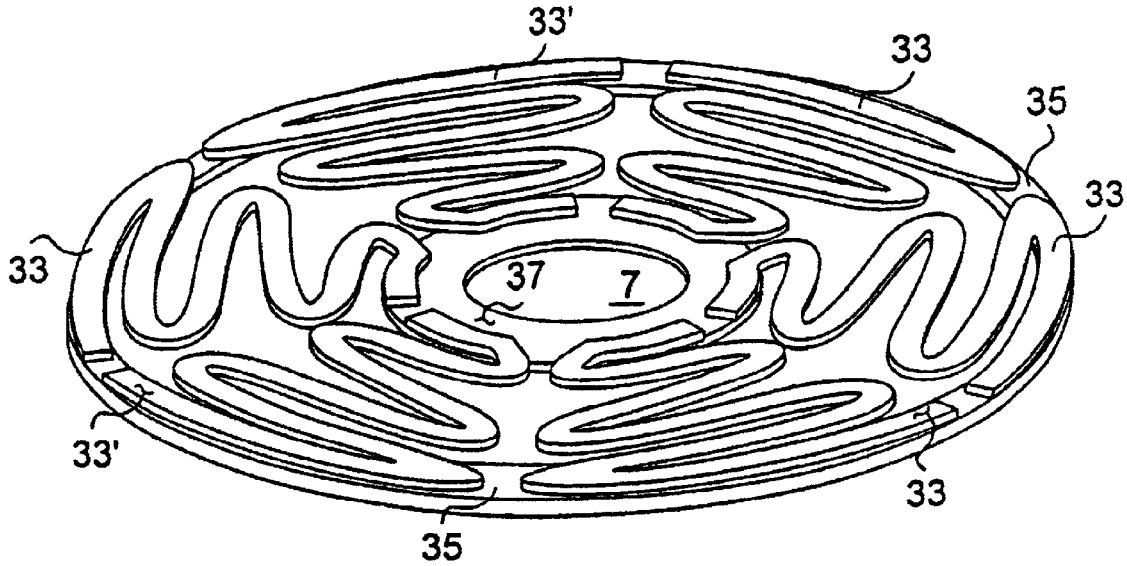
FIG. 4 is a perspective view of a representative spider of the present invention using six separate serpentine segments of the type shown in FIG. 3.
Figure 3:
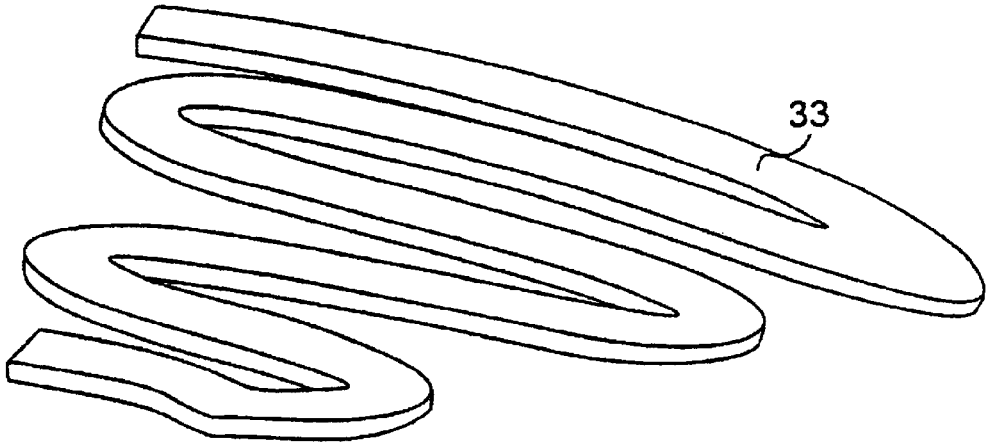
FIG. 3 is a perspective view of a single spider serpentine segment.

FIG. 3 is a perspective view of a separate multi-curved serpentine segment 33 for a spider of the present invention as in FIG. 4. This configuration permits the assembly of a spider by combining a plurality of segments 33 attached to a separate outer ring 35 and a separate inner ring 37 as shown in FIG. 4. FIG. 4 shows six of the segments of FIG. 3 with alternating segments flipped over relative to the adjacent segments with the segments as shown in FIG. 3 being segments 33 and those that have been flipped over as segments 33'. Segments 33 as compared to segments 9–19 of FIG. 1, with both made of the same material and material thickness, will have a softer flex while providing approximately the same anti-wobble characteristic. The softer flexing being contributed by the inclusion of three turns in each segment in FIGS. 3 and 4 as opposed to one turn in each segment of FIG. 1.

Figure 5:
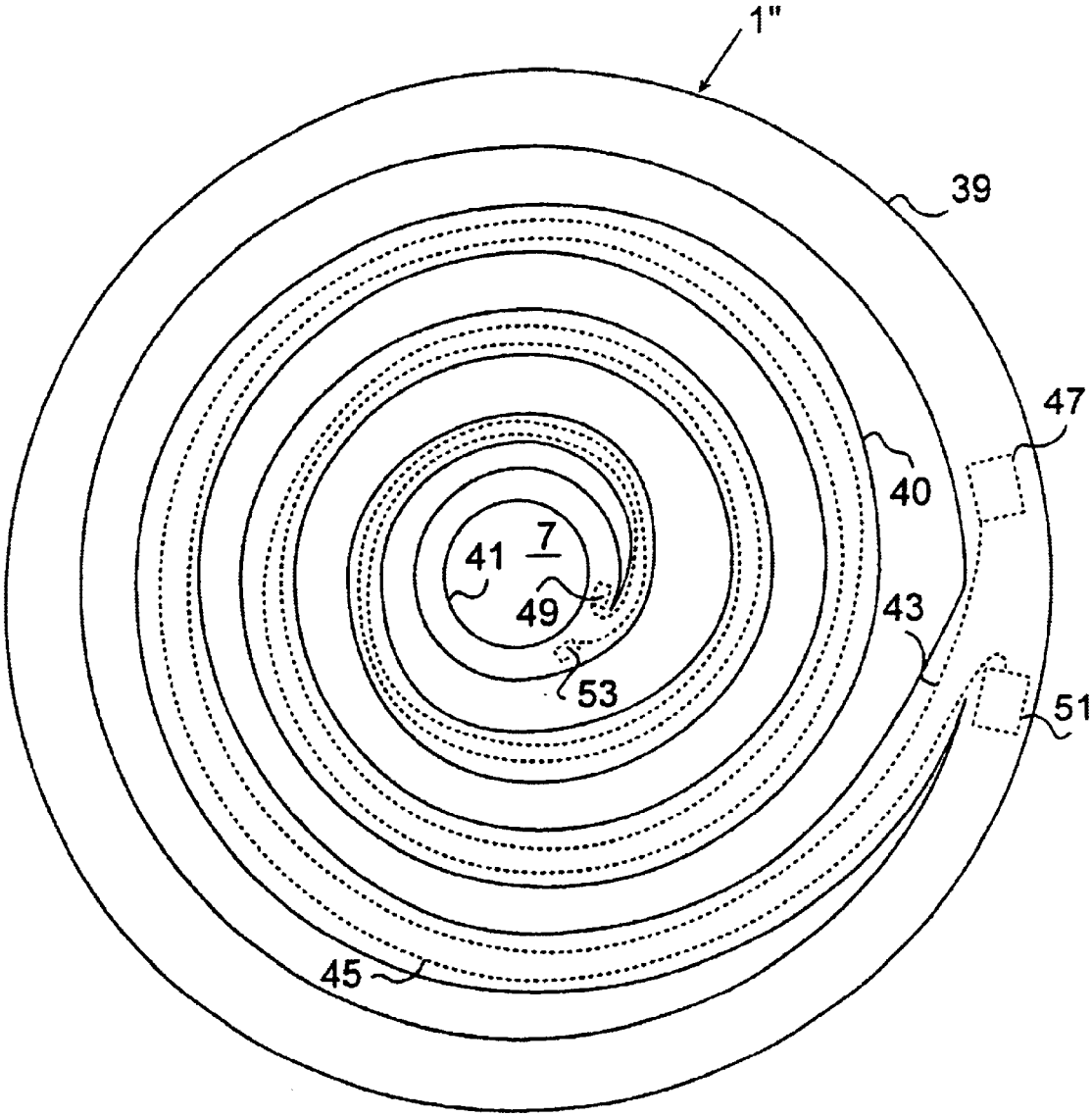
FIG. 5 is a plan view of spiral spider of the present invention with two electrical conductors between the outer and inner rings.

FIG. 5 is a plan view of the simplest spider 1" of the present invention. This configuration includes an outer ring 39, an inner ring 41 and a spiraling web 40 between the rings with an increasingly tighter radius as it approaches the inner ring 41. Also shown are two electrically conductive paths between the inner and outer rings, the first conductor 43 shown as dashed lines and the second conductor is shown as dotted lines (dashed and dotted lines are used to minimize the confusion that solid lines for the conductors would present). Each of conductors 43 and 45 extend from a connection pad 47 and 51, respectfully, on the surface of outer ring 39 to connection pads 49 and 51, respectively, on inner ring 41. Alternatively, though less desirable, a twisted pair of wires could be mounted to spiral 40 with a flexible compound such as rubber cement or silicon rubber. Additionally, one has the option of including wires on both the top and bottom of spiraling web 40.

While the configuration of spider 1" is not ideal since it is not as stable or free of wobble and possible rotation, it has been presented here to illustrate that the present invention can be accommodated with a spider with any number of sectors, an odd number or an even number, including one as shown in FIG. 5. For maximum stability with minimal rotation and wobble an even number of segments. The most stability is provided when an even number of segments are used with the segments on either side of a segment having a mirror plan view configuration as shown in FIGS. 1, 2 and 4. With such an alternating configuration wobble and rotation are minimized.

The spiders of the present invention can be made in several different ways from a variety of materials. A speaker spider, or damper, of the present invention could be made of a flat flexible and resilient material such as an epoxy printed circuit board with copper clad on top that is machined to present the desired number and placement of conductive paths. Increasing or decreasing the width of the segments of the spider vary the spring constant, which changes the compliance (up and down). The use of an electrically conductive trace on the surface of the segments of the spider exposes each conductor to movement through air as the speaker is activated thus leading to better performance due to the cooling process presented by that movement through air.

Another method of manufacturing the spider with conductors of the present invention is to make a vacuum draw mold whereby high temperature plastic can be used via the common known process of vacuum molding and then applying a conductive film to the surface of the spider in the desired pattern by plating or with an adhesive.

Yet another method of manufacturing the spider with conductors is via a cold molding process of epoxy. In this method, the desired conductors are placed in the mold with the epoxy then poured in and left to harden. This type of construction offers additional electric insulation for the conductors.

Still another method of manufacture could be the use of an injection molding process that relies on a mold to be constructed with a void that has the desired shape of the spider. Initially, the desired lead wires are fed into the mold. Next the mold is closed and injected with the selected material for the spider. There are many materials that are suited for this process. Some are simple composites and can be chosen to provide a desired modulus of elasticity of the finished spider. This can easily be done by changing the type of composite and the proportion of the materials used to create it.

Figure 6:
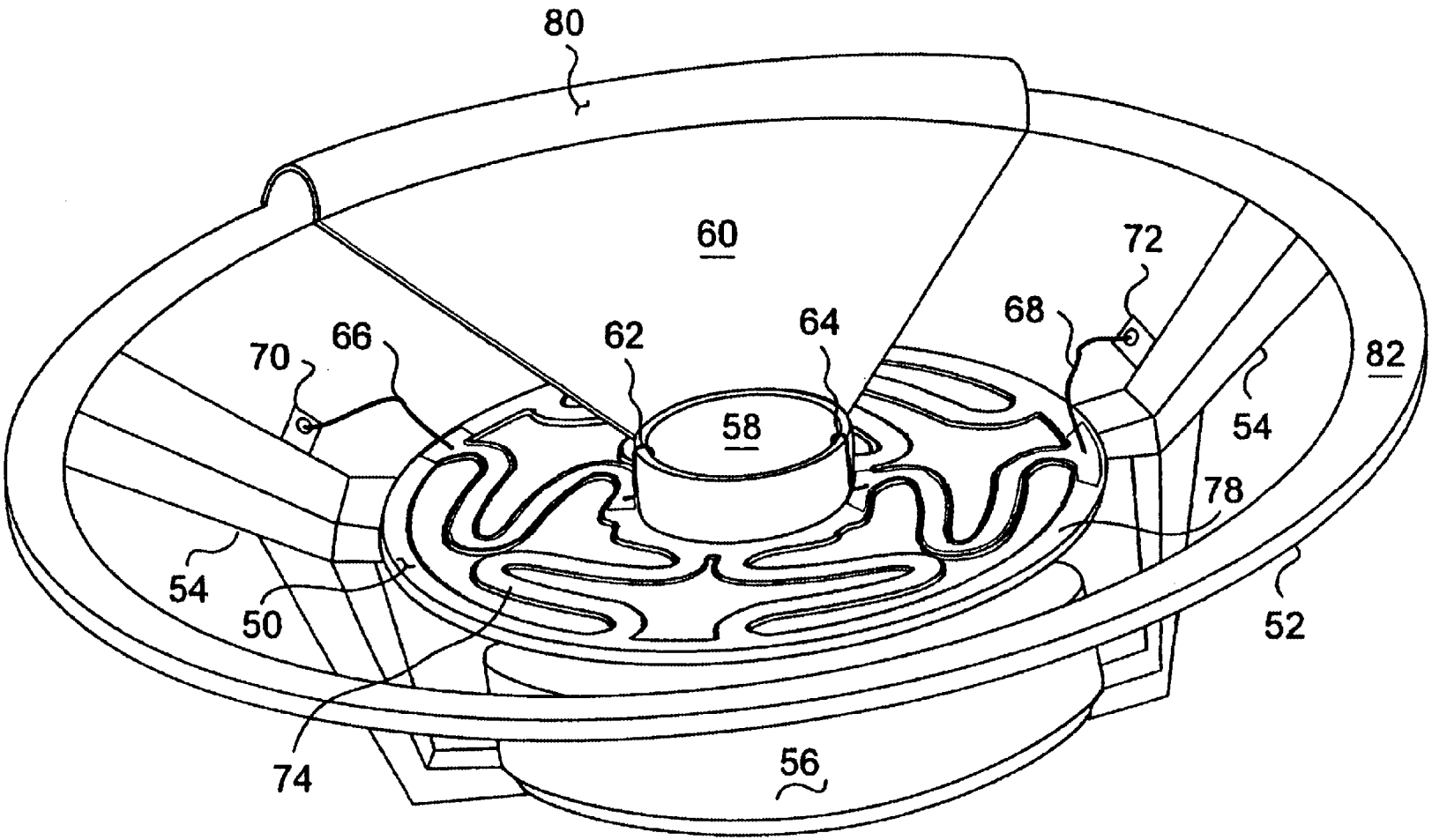
FIG. 6 is a partial cut-away perspective view of an audio speaker incorporating a spider design of the present invention.

FIG. 6 is a perspective view of a typical audio speaker incorporating a spider of the present invention with cone 60 partially cut-away to show the details of the interaction of the various components beneath the cone. The largest diameter opening of cone, or sound radiating surface, 60 attached to surround 80 which in turn is attached to opening, or mouth 82 of frame, or basket, 52. Surround 80 is a flexible suspension component of the speaker assembly. In the bottom of basket 52 is speaker magnet assembly 56 with voice coil assembly 58 suspended around a magnetic pole. Spider 50 of the present invention is shown with inner ring 76, outer ring 78 and four serpentine segments 74 (one hidden beneath the non-cut-away portion of speaker cone 60) extending between the inner and outer rings. Outer ring 78 of spider 50 is affixed within speaker basket 52 to struts 54 (one hidden beneath the non-cut-away portion of speaker cone 60) in substantially the same plane as the interconnection of inner ring 76, the center of cone 60 and the top end of the bobbin of voice coil assembly 58 with magnet assembly 56 below spider 50. Thus the plane of spider 50 is intermediate, and substantially parallel, to the planes of the mouth and bottom of the speaker frame or basket.

For convenience of assembly, each of serpentine segments 74 has a conductive path on the top surface with those conductive paths electrically isolated from each other. Segment 74 in the lower left of FIG. 6 has voice coil free end 62 electrically connected thereto on inner ring 76. Similarly, segment 74 in the upper right of FIG. 6 has voice coil free end 64 electrically connected thereto on inner ring 76. To provide the electro-audio signal to the voice coil, through the conductive path on the corresponding segment, speaker input terminal 70 in the lower left of FIG. 6 is electrically interconnected with the adjacent segment 74 on outer ring 78 with wire 66. To complete the electro-audio signal path to the voice coil, speaker input terminal 72 in the upper right of FIG. 6 is electrically interconnected with the adjacent segment 74 on outer ring 78 with wire 68. Thus when a signal is applied to terminals 70 and 72 the electrical path through the voice coil is complete causing the voice coil to move within the magnetic field of magnet 56 as the electrical signal through the voice coil varies From FIG. 6 the above discussed advantages of the present invention can easily be seen: no flapping signal wires on the surface of the speaker cone to cause distortion and no long flexing signal wires in free space between the under surface of the cone and the speaker input terminals. There is a short, fixed distance between the top of the voice coil bobbin and the inner ring of the spider where the ends of the voice coil leads are attached to the spider. Similarly, there is a fixed relationship, and therefore distance between the outer ring of the spider and the speaker input terminals.

While the present invention is shown with several potential embodiments, the number of configurations that can be used is probably endless. The present invention is independent of the actual configuration of the spider and is clear from the examples given here. One skilled in the art could think of numerous configurations for the spider, methods of manufacturing the spider, and numerous ways of applying or encasing the necessary electrical conductors on or in the material of such spiders.

What is claimed is:

1. A speaker comprising:

a frame having a first perimeter opening and a bottom region rigidly spaced apart from the opening with said first perimeter defining a first plane;

a magnet assembly rigidly affixed within and to the bottom region of the frame; and a voice coil driven movable assembly suspended from the opening of the frame and disposed to move along a longitudinal axis of said speaker with that axis being substantially perpendicular to said first plane, said voice coil driven movable assembly including:

an outer flexible suspension having a first edge and a second edge with the first edge connected to said first perimeter of said frame and a first perimeter location of said voice coil driven moving assembly;

a sound radiating surface having an outer edge and a central region with the outer edge affixed to the second edge of the outer flexible suspension;

a bobbin having an upper edge, a lower edge and a central region with the central region of the bobbin sized, shaped and loosely suspended around a portion of the magnet assembly, with the upper edge of the bobbin affixed to central region of the sound radiating surface, and with a wire voice coil wound on said bobbin with a pair of wires extending away from the bobbin; and an inner flexible suspension includes an inner portion, an outer portion and at least one serpentine segment extending therebetween, with a separate end affixed to each of the inner and outer portions, with the inner portion affixed to the central region of the sound radiating surface in close proximity to the upper edge of the bobbin, with the outer portion affixed within and to the frame between the opening and the bottom thereof, with a pair of electrically conductive paths extending between the inner and outer portions integral with said at least one serpentine segment with one of said pair of wires of the voice coil connected to each of the pair of electrically conductive paths at the inner portion of the inner flexible suspension.

2. The speaker as in claim 1 further including:

a pair of input terminals affixed within said frame in close proximity with the outer portion of the inner flexible suspension and the pair of electrically conductive paths; and a pair of wires, one wire attached between each of the pair of input terminals and each of the pair of electrically conductive paths on the outer portion of the inner flexible suspension.

3. The speaker as in claim 1 wherein the inner flexible suspension defines a second plane that is substantially parallel to the first plane when the voice coil driven movable assembly is at rest.

4. The speaker as in claim 1 wherein said at least one serpentine segment is in the form of a spiral of reducing diameter as it extends from the outer portion to the inner portion of the inner flexible suspension.

5. The speaker as in claim 1 wherein said at least one serpentine segment includes at least three segments, each of the segments being spaced around said longitudinal axis and each segment being fixed between the outer and inner portions of the inner flexible suspension.

6. The speaker as in claim 1 wherein said at least one serpentine segment includes an even number of segments, each of the segments being spaced around said longitudinal axis and each segment being fixed between the outer and inner portions of the inner flexible suspension.

7. The speaker as in claim 6 wherein each segment has a mirror image pattern to that of the adjacent segments immediately adjacent.

8. A speaker comprising:

a frame having a first perimeter opening and a bottom region rigidly spaced apart from the opening with said first perimeter defining a first plane;

a magnet assembly rigidly affixed within and to the bottom region of the frame; and a voice coil driven movable assembly suspended from the opening of the frame and disposed to move along a longitudinal axis of said speaker with that axis being substantially perpendicular to said first plane, said voice coil driven movable assembly including:

an outer flexible suspension having a first edge and a second edge with the first edge connected to said first perimeter of said frame and a first perimeter location of said voice coil driven moving assembly;

a sound radiating surface having an outer edge and a central region with the outer edge affixed to the second edge of the outer flexible suspension;

a bobbin having an upper edge, a lower edge and a central region with the central region of the bobbin sized, shaped and loosely suspended around a portion of the magnet assembly, with the upper edge of the bobbin affixed to central region of the sound radiating surface, and with a wire voice coil wound on said bobbin with a pair of wires extending away from the bobbin; and an inner flexible suspension includes an inner portion, an outer portion and at least three segments extending therebetween, each with a separate end affixed to each of the inner and outer portions and each of the segments being spaced around said longitudinal axis, with the inner portion affixed to the central region of the sound radiating surface in close proximity to the upper edge of the bobbin, with the outer portion affixed within and to the frame between the opening and the bottom thereof with the inner flexible suspension defining a second plane that is substantially parallel to the first plane, with a pair of electrically conductive paths extending between the inner and outer portions integral with at least one segment with one of said pair of wires of the voice coil connected to each of the pair of electrically conductive paths at the inner portion of the inner flexible suspension.

9. The speaker as in claim 8 further including:

a pair of input terminals affixed within said frame in close proximity with the outer portion of the inner flexible suspension and the pair of electrically conductive paths; and a pair of wires, one wire attached between each of the pair of input terminals and each of the pair of electrically conductive paths on the outer portion of the inner flexible suspension.

10. The speaker as in claim 8 wherein the inner flexible suspension defines a second plane that is substantially parallel to the first plane when the voice coil driven movable assembly is at rest.

11. The speaker as in claim 8 wherein said at least at least three segments includes an even number of segments, each of the segments being spaced around said longitudinal axis and each segment being fixed between the outer and inner portions of the inner flexible suspension.

12. The speaker as in claim 11 wherein each segment has a mirror image pattern to that of the adjacent segments immediately adjacent.

13. The speaker as in claim 12 wherein each segment has a serpentine shape.

14. The speaker as in claim 8 wherein said electrically conductive paths are integral with said segments.

15. The speaker as in claim 8 wherein said electrically conductive paths are conductors molded into said segments.

16. The speaker as in claim 8 wherein said electrically conductive paths are conductors bonded to a surface of said segments.

17. The speaker as in claim 8 wherein each segment includes the electrically conductive path with the individual electrically conductive paths electrically isolated from each other at the inner and outer portions of the inner flexible suspension.

18. The speaker as in claim 17 wherein said inner flexible suspension is constructed from printed circuit stock with breaks etched between each conductive path on each segment on the inner and outer portions of the inner flexible suspension.

* * * * *